US009518776B2

(12) United States Patent
Baldo

(10) Patent No.: US 9,518,776 B2
(45) Date of Patent: Dec. 13, 2016

(54) REFRIGERATING APPLIANCE

(75) Inventor: Federico Baldo, Santa Lucia di Piave (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 131 days.

(21) Appl. No.: 13/979,867

(22) PCT Filed: Feb. 9, 2012

(86) PCT No.: PCT/EP2012/052202

§ 371 (c)(1),
(2), (4) Date: Oct. 31, 2013

(87) PCT Pub. No.: WO2012/110393

PCT Pub. Date: Aug. 23, 2012

(65) Prior Publication Data

US 2014/0042886 A1 Feb. 13, 2014

(51) Int. Cl.
*F25D 23/02* (2006.01)
*F25D 25/02* (2006.01)
(Continued)

(52) U.S. Cl.
CPC ..... *F25D 23/028* (2013.01); *F25D 25/02* (2013.01); *A47B 57/06* (2013.01); *F25D 23/04* (2013.01); *F25D 25/04* (2013.01)

(58) Field of Classification Search
CPC ..... F25D 23/028; F25D 25/02; F25D 25/04; F25D 23/04; F25D 2325/021; A47B 57/06; A47B 57/08; A47B 57/10; A47B 57/12; A47B 57/14; A47B 57/16; A47B 57/18; A47B 57/20; A47B 57/26; A47B 57/265
(Continued)

(56) References Cited

U.S. PATENT DOCUMENTS 3,610,174 A * 10/1971 Kesling ..... 108/56.1
5,199,778 A * 4/1993 Aoki et al. ..... 312/408
(Continued)

FOREIGN PATENT DOCUMENTS

DE 202007013356 10/2008
WO 2008062965 5/2008
(Continued)

OTHER PUBLICATIONS

International Search Report for PCT/EP2012/052202, dated May 16, 2012, 2 pages.
(Continued)

*Primary Examiner* — Ryan A Doyle
(74) *Attorney, Agent, or Firm* — Pearne & Gordon LLP

(57) ABSTRACT

The invention relates to a refrigerating appliance (1) including a body (2) in which a refrigerating compartment (3) is defined and a door (4) connected to said body to open and close said compartment, and a height adjustable support assembly (10,10',100) connected to said body and/or said door. The refrigerating appliance (1) further comprises a rail (23*a*,23*b*;23*a'*,23*b'*) including a rack portion (21) attached to said body (2) within said compartment (3) and/or to said door (4), the rail extending substantially along a vertical axis. The height adjustable support assembly (10;10';100) comprises: a support member (11;11';11") to support items to be refrigerated/frozen; a height adjustment gear (15*a*,15*b*) rotatably connected to the support member (11;11';11"), the gear meshing with the rack portion (21) so that the support member can be vertically moved along the rail (23*a*,23*b*; 23*a'*,23*b'*); a unidirectional stopper unit (19; 70) to regulate rotation of the height adjustment gear (15*a*,15*b*) when meshed with the rack portion (21), allowing an upward movement of the support member (11;11';11") along the vertical axis and blocking downward movements along the
(Continued)

vertical axis; and a lever (50) coupled to the unidirectional stopper unit, the lever being apt to disengage the unidirectional stopper unit so as to allow a downward movement of the support member (11;11';11") along the vertical axis when operated.

19 Claims, 14 Drawing Sheets

(51) Int. Cl.
*A47B 57/06* (2006.01)
*F25D 25/04* (2006.01)
*F25D 23/04* (2006.01)

(58) Field of Classification Search
USPC ..... 312/405.1, 408; 108/106–110
See application file for complete search history.

(56) References Cited

U.S. PATENT DOCUMENTS 6,065,821 A * 5/2000 Anderson et al. ..... 312/408
2003/0011291 A1* 1/2003 Moreno-Olguin et al. ..... 312/405.1
2008/0048081 A1* 2/2008 Costa et al. ..... 248/241
2008/0246382 A1* 10/2008 Kang et al. ..... 312/408
2009/0121600 A1* 5/2009 Eisele et al. ..... 312/408
2010/0175414 A1* 7/2010 Kim ..... 62/377
2010/0176702 A1* 7/2010 Kim ..... 312/405.1
2010/0176703 A1* 7/2010 Kim ..... 312/408
2011/0290807 A1* 12/2011 Calvillo et al. ..... 220/592.02

FOREIGN PATENT DOCUMENTS

WO 2008078870 7/2008
WO 2010054683 5/2010

OTHER PUBLICATIONS

Office Action in European Patent Application No. 11155015.8-2301, Dated Jul. 1, 2011.

* cited by examiner

REFRIGERATING APPLIANCE

The present invention relates to a refrigerating appliance comprising walls defining a refrigerator compartment and a door to close the same. The refrigerating appliance includes at least a support member for supporting items in the refrigerator compartment and/or a support member for the same purpose attached to the door. The height of the support member(s) is(are) adjustable in a relatively easy manner.

Refrigerators define in their interior a refrigerator compartment for the storage of items to be refrigerated or frozen, which is generally subdivided in sub-compartments by means of vertically separated shelves. Regardless of the objective size of sub-compartments, it has been always desired to provide a rationale use of the internal space of the refrigerating appliance, in order to maximize the usable space for the storage of items. Due to the fact that the size of these items can greatly vary, it is also desirable that the usable space can be adapted and reshaped accordingly depending on the changing needs (i.e. addition, removal or replacement of items).

As said, refrigerators generally comprise shelves for the reception of the refrigerated or frozen products which are connected to the walls of the refrigerator compartment by means of support elements. For the above mentioned reason, it is desirable to be able to control the vertical positioning of the same in an easy manner.

Shelves for the support of items are generally also attached on one side of the door internal to the refrigerator compartment. As discussed above in connection with the compartment's shelves, the door shelves are preferably adjustable along the vertical direction so as to increase the usable space changing the spacing between shelves according to the items' dimensions.

In the prior art, it is known to have shelves, either to be fixed inside the compartment or attached to the door, which are supported by a plurality of protrusions, the number of which is larger than the number of shelves to have the possibility to adjust the position of the latter on the vertical axis. This type of adjustment is not practical because all the items on the shelf must be removed before making the adjustment operation.

The need of height adjustable shelves which do not need to be removed from the refrigerating appliance in order to change their vertical positioning is therefore strongly felt in this field and several solutions have been proposed.

U.S. Pat. No. 5,913,584 in the name of White Consolidated Industries discloses a vertically adjustable shelf for a refrigerator which includes a mounting assembly which cooperates with a pair of vertically extending tracks to position the adjustable shelf at a plurality of predetermined positions, a support assembly is carried by the mounting assembly and movable relative to the mounting assembly so that the support assembly can be positioned at each position between the plurality of predetermined positions, and an encapsulated shelf carried by the support assembly. The mounting assembly has a pair of vertical rack gears and a pair of track mounting brackets which engage the tracks. The support assembly includes a knob centrally located at a forward end of the shelf and a gear box connecting the knob with the rack gears so that the support assembly moves relative to the mounting assembly when the knob is turned. The invention described in U.S. Pat. No. 5,199,778 in the name of Matsushita Refrigeration Company relates to a shelf apparatus for a refrigerator which raises and lowers a refrigerator's food storage shelves (1) in an analog manner, making it possible to determine the positions of the shelves (1) largely in accordance with the size of food items stored inside the refrigerator. More particularly, racks (14*b*) are provided on the left and right sides of the refrigerator's interior (12), gears (5) which engage these racks (14*b*) are provided on the shelves (1) of the refrigerator, and the food storage shelves (1) are raised and lowered by rotating these gears (5).

U.S. Pat. No. 71,788,890 in the name of LG Electronics is relative to a shelf height adjuster of a refrigerator. According to the present invention, gear portions are vertically formed on both side surfaces on a refrigerating chamber of the refrigerator. Height adjustment gears which are engaged with the gear portions are rotatably installed in opposite sides of a shelf, respectively. Each stopper for regulating the rotation of each height adjustment gear is engaged to the height adjustment gear by means of a spring, and thus, it causes the height adjustment gear not to rotate. When the height of shelf is adjusted, the height adjustment gears are made freely rotate by releasing the stoppers from the height adjustment gears, and thus, the height of the shelf may be adjusted without taking out the shelf from the refrigerator.

U.S. Pat. No. 6,065,821 in the name of Maytag Corporation describes an adjustable shelf is able to be initially attached to support structure within a storage area of a cabinet at any one of a multitude of vertical heights and then can be readily, mechanically adjusted to reposition the shelf as desired. In one embodiment, the shelf includes a pair of sprockets which are interengaged with mating slots formed in a pair of similarly constructed and laterally spaced support rails positioned within the cabinet. The drive arrangement for the sprockets can be manually, electrically or otherwise driven to provide infinite adjustments for the vertical shelf. When an electrical power motor is utilized as the drive source, the motor is preferably mounted upon a frame of the shelf and electrical power is transmitted to the motor through, at least in part, the support rail structure. In addition, the adjustable shelf carries at least one shift limiting member that can be positioned in either an in-use position, wherein the shift limiting member assures that the sprockets are maintained in engagement with the support rails, or in a release position, wherein the shelf can be either removed from or mounted upon the rails. In addition, the support rails are preferably constructed to accommodate various types of shelves in order to present a more universal, overall shelving assembly. KR2010085252 discloses a height controlling device for refrigerator shelf, has rack gear installed in inner wall of refrigerator, pinion gear connected with rack gear, and driving unit for driving pinion gear to move shelf to top and bottom directions. A height controlling device for a refrigerator shelf comprises a rack gear which is installed to the longitudinal direction both side inner faces of a refrigerator, a shelf which includes a pinion gear engaging in the rack gear, and a driving member which drives the pinion gear in order that the shelf moves along the rack gear to the top and bottom with being slid and is a drive shaft in which a worm gear transferring torque to the pinion gear is formed. A screw part is formed in the circumference of the longitudinal direction of the drive shaft. The screw part is combined with a moving lever rotating the drive shaft with a linear motion.

KR2009125317 in the name of LG Electronics relates to a shelf apparatus for refrigerator, has frame installed in two sides of shelf, and transmission mechanism connected to operating apparatus, where shelf is moved to top and bottom according to manipulation of operating apparatus. A refrigerator and a refrigerator shelf apparatus are provided to improve external appearance by installing a transfer mechanism and an operating mechanism within a frame. The frames are fixed to both sides within the refrigerator as leaving a space for the shelf. The operating mechanism is supplied to at least one inside of the frames of the both sides, and operated up and down. The transfer mechanism is connected to the operating mechanism within the frame, and supports one side of the shelf. According to a manipulation of the operating mechanism, the shelf moves up and down.

The present invention is relative to a refrigerating appliance comprising a body in which a compartment for the refrigeration of items is defined, and a door hinged to the body for opening and closing the compartment. The refrigerating appliance comprises at least a support assembly the position of which is adjustable along the vertical direction, in a manner better described below. This support assembly can be either a so called "cabinet support assembly", i.e. including a support member, which is positioned inside the compartment, or a "door support assembly", i.e. including a support member, which is connected to the door of the appliance.

For the purposes of the present invention, with "support member" it is intended either a shelf or another member, like a drawer, a bin or a hook, suitable to support food items or other sort of items typically stored in a refrigerator or freezer.

Support members are generally moved by users by hand, by applying a suitable force (e.g. pushing, pulling or rotating) on adjusting means apt to regulate the height of the shelf. Generally, in a common use of the appliance, a user opens the refrigerator and, holding an item to be refrigerated on his/her hands, realizes that the actual spacing between support members is not suitable for the size of the item he/she is holding and therefore decides to change the spacing between shelves. Due to the fact that the user has a full hand, it is desirable to have a support member that can be moved along the vertical direction, either up or down, using a single hand.

In addition, one of the risks of moving the support member along a vertical direction, in particular when the support member is loaded, is that the support member tilts—for example because the force applied to the support member in order to move the same is not uniformly distributed along the member's relatively broad width—and the supported items may fall to the ground.

The support assembly of the present invention does not need to be removed from the appliance in order to adjust its height: to obtain the vertical adjustment, the support member substantially slides along rail(s) fixed on the appliance; in particular the rail includes a rack portion meshed with a gear which is connected to the support assembly. This rack and pinion gear meshing allows the vertical movement of the support member along a straight line. In addition, according to a characteristic of the invention, the support assembly is so realized that it can be shifted up and down along the vertical direction using a single hand. This is realized thanks to a unidirectional mechanism which controls the rotation of the gear and allows the movement of the support member in a direction by means of a thrust, i.e. it allows upward movement of the support member when a force pointing upwards is applied to the support member itself, and it blocks downward motion of the same. The unidirectional mechanism cooperates with a lever, the lever disengages the unidirectional mechanism when activated, for example by pushing, so that also the downwards movement of the support member is possible.

In addition, according to a preferred embodiment of the invention, the risk of tilting the support member of the invention while moving the same to change its height is minimized. Indeed, preferably the refrigerating appliance comprise two rails, each including a rack portion, and the support member also includes two gears, each gear coupled to a rack portion in the above mentioned meshing, and the two gears are connected via a shaft so that rotation of any of the two gears implies a rotation also of the other of the two gears, so that on both sides of the support member the vertical movement is the same.

The invention will be better described below in a non limiting example on the basis of the appended drawings. The figures show:

FIG. 1 is a perspective view of a refrigerating appliance including a cabinet support assembly realized according to the present invention;

FIG. 1*a* is a frontal cross-section of a portion of the refrigerating appliance of FIG. 1;

Figure 5:
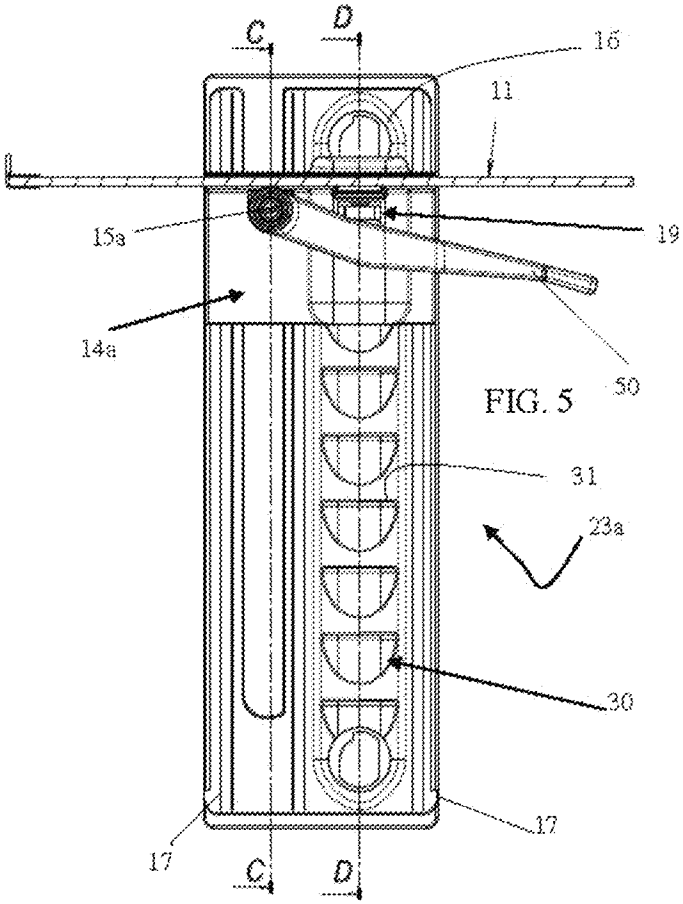
FIG. 5 is a cross-section of the cabinet support assembly along the line B-B of FIG. 4.
Figure 9B:
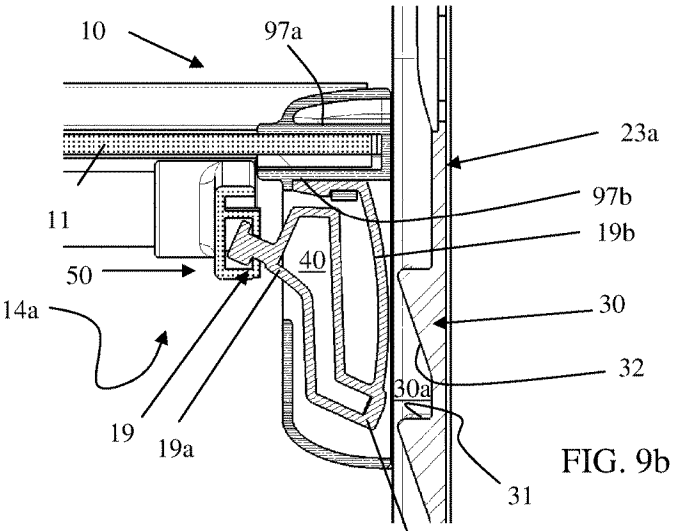
Figure 9A:
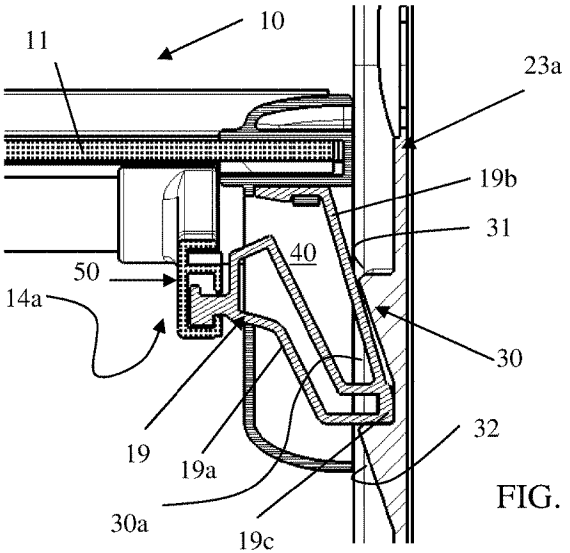
Figure 10:
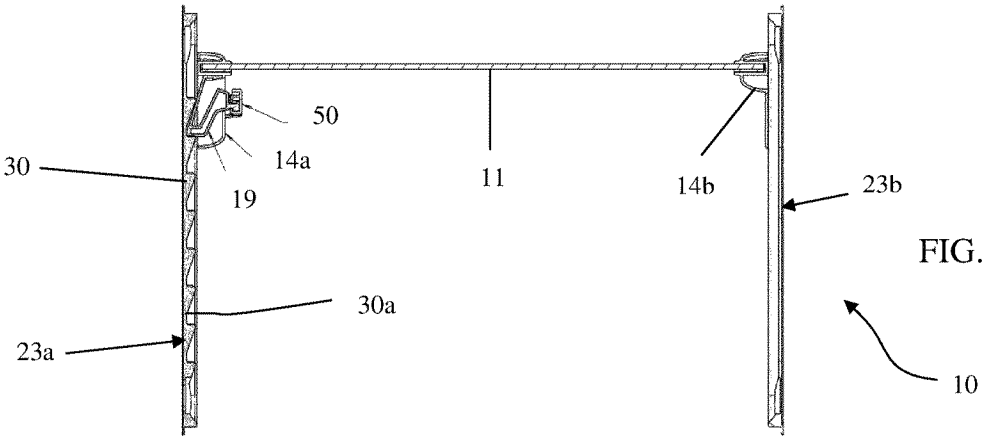
Figures 11, 14:
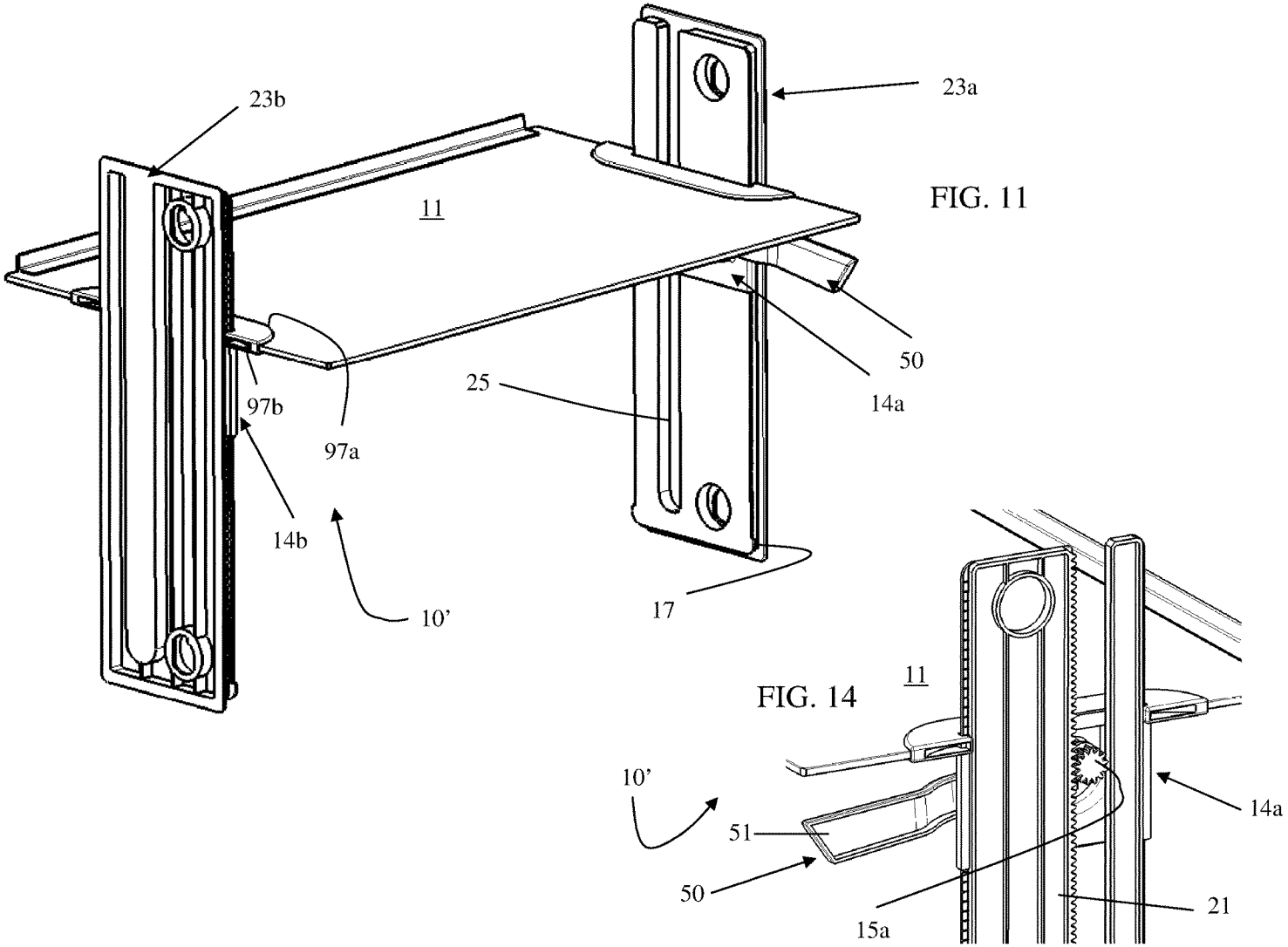
Figure 12:
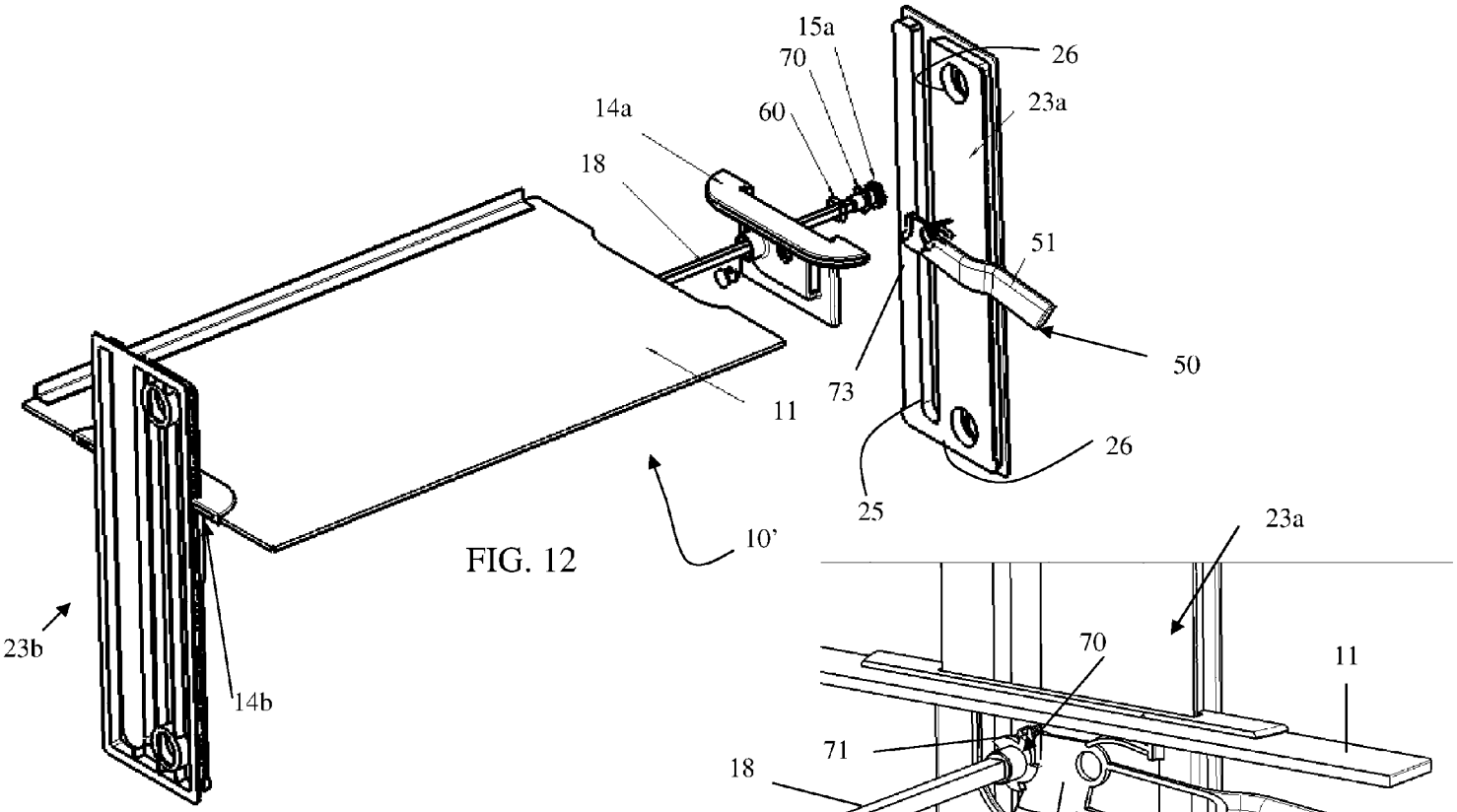
Figure 13:
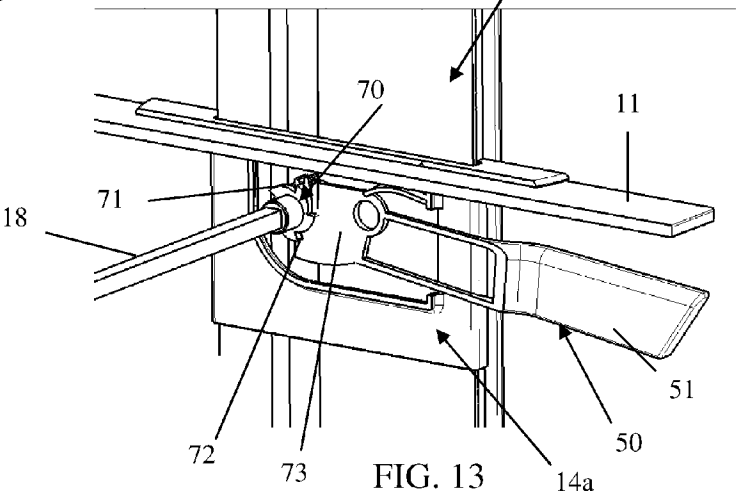
Figure 16:
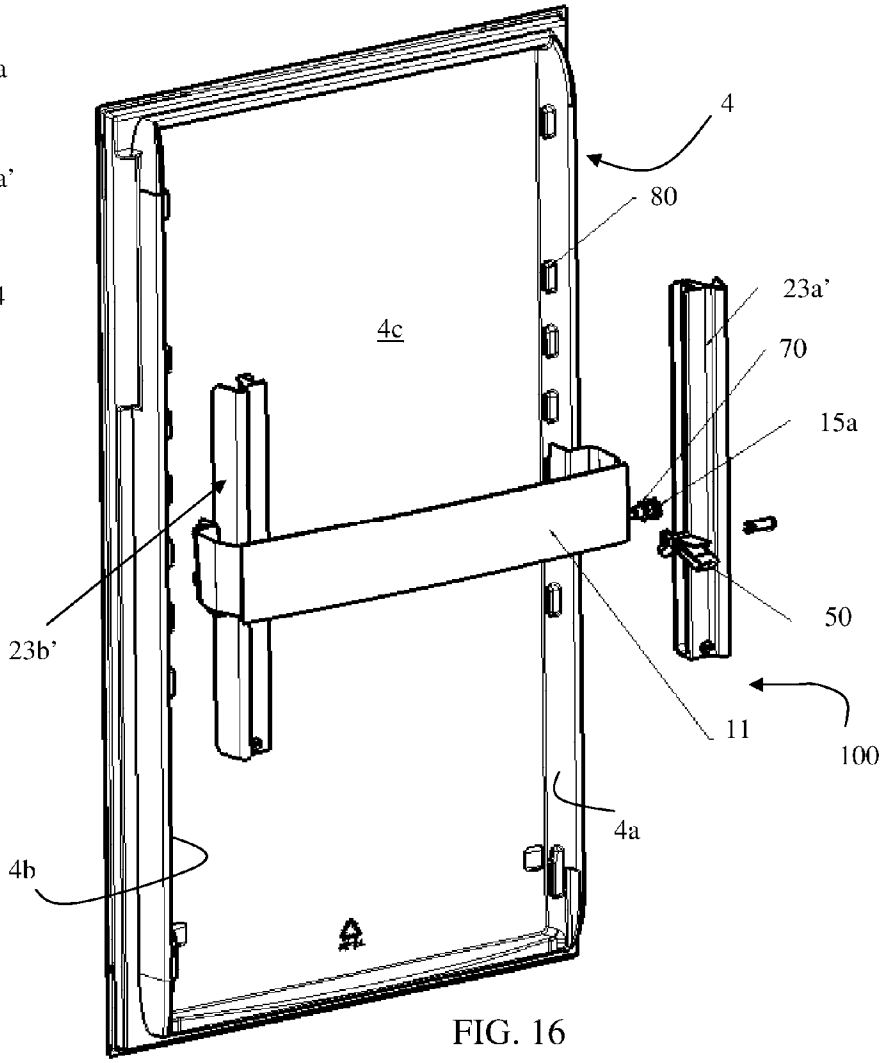
Figure 15:
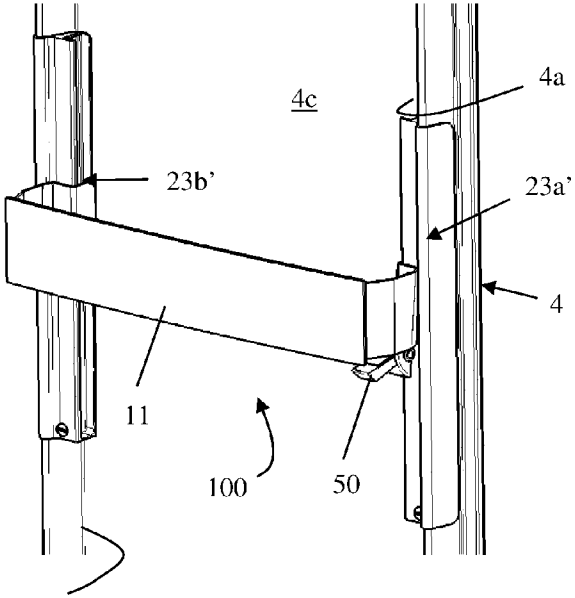
Figure 16A:
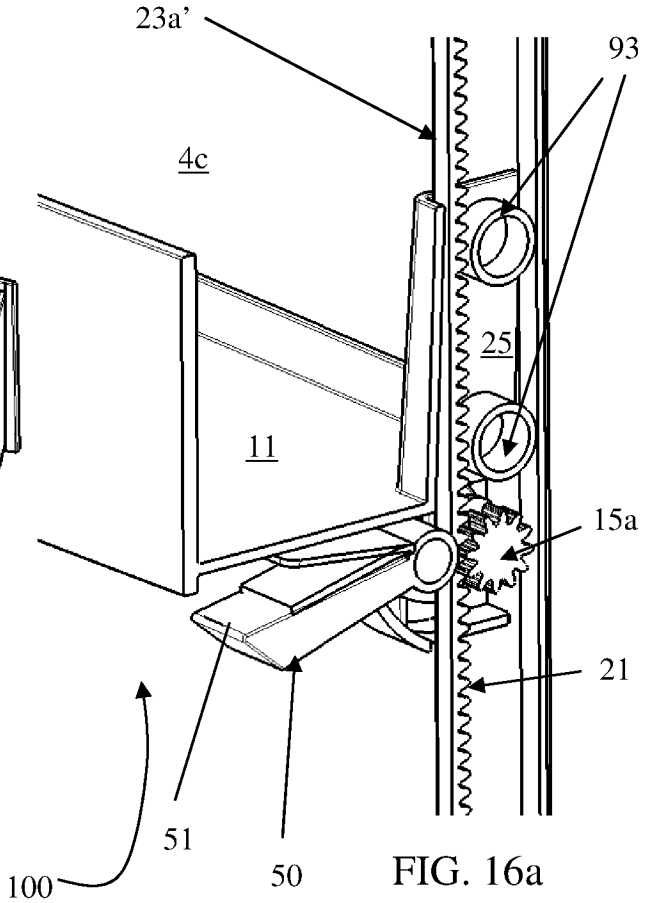
Figure 17:
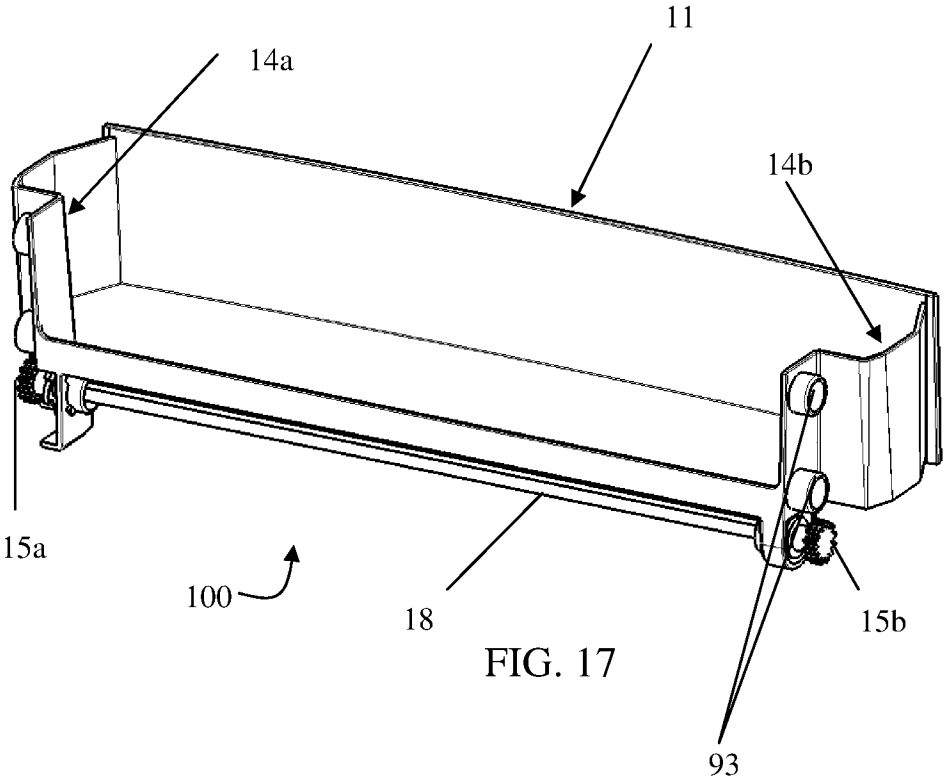

FIGS. 9*a* and 9*b* are two cross sections along the line D-D of FIG. 5 of a detail of the cabinet support assembly in an engaged position where downwards movement of the support member are blocked, and is a disengaged position, where downwards movements of the support member are allowed, respectively;

FIG. 10 is a cross section along the line D-D of FIG. 5 of the cabinet support assembly;

FIG. 11 is a perspective view of a second embodiment of a cabinet support assembly realized according to the invention;

FIG. 12 is a perspective exploded view of the second embodiment of the cabinet support assembly of FIG. 11;

FIG. 13 is a perspective view of a detail of the cabinet support assembly of FIGS. 11 and 12;

FIG. 14 is a perspective view of an additional detail of the cabinet support assembly of FIGS. 11 and 12;

FIG. 15 is a partial perspective view of a door for a refrigerating appliance including a door support assembly realized according to the present invention;

FIG. 16 is a perspective exploded view of the door and door support assembly of FIG. 15;

FIG. 16*a* is a partial perspective view partially sectioned of the door, door support assembly and door support assembly rail of FIGS. 15 and 16;

FIG. 17 is a perspective view of the door support assembly of FIGS. 15, 16 and 16*a;*

Figure 1A:
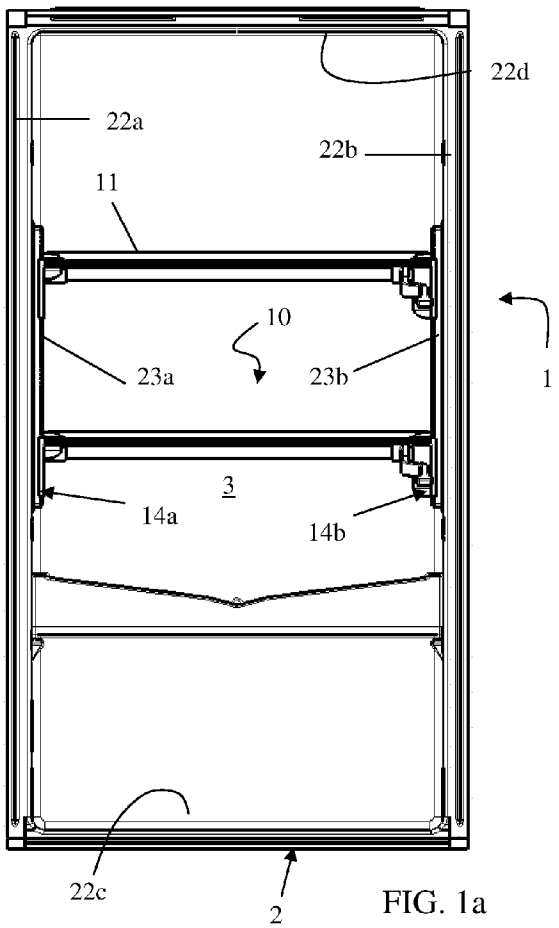
Figure 1:
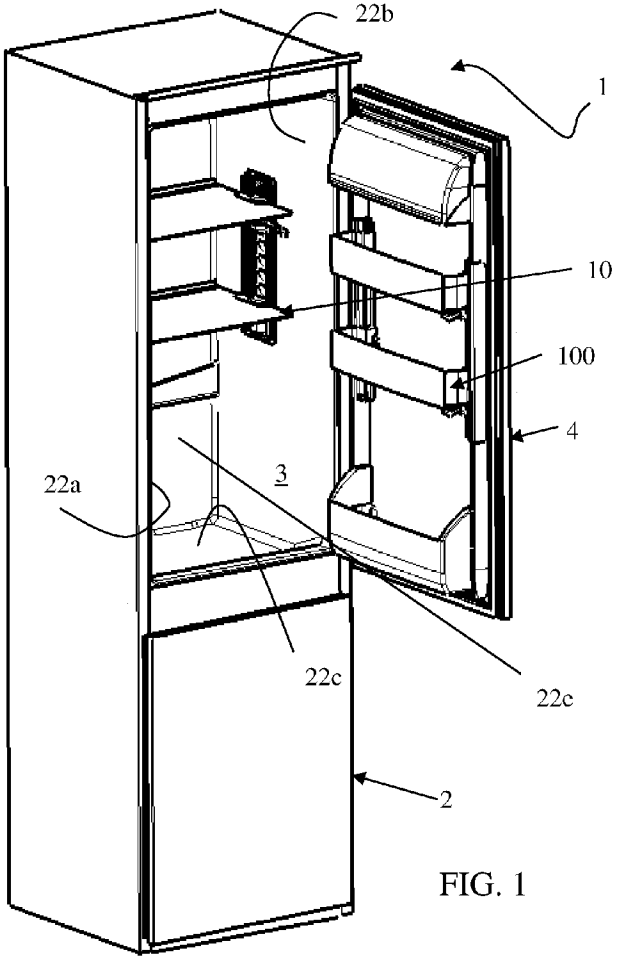
Figure 2:
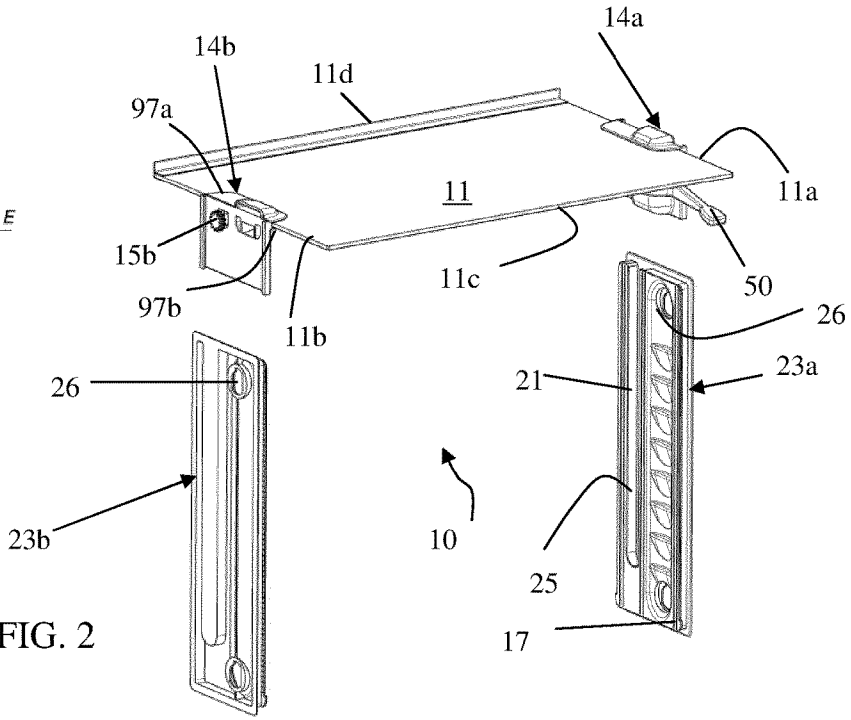
FIG. 2 is a partially exploded perspective view of the cabinet support assembly included in the appliance of FIGS. 1 and 1*a;*
Figure 4:
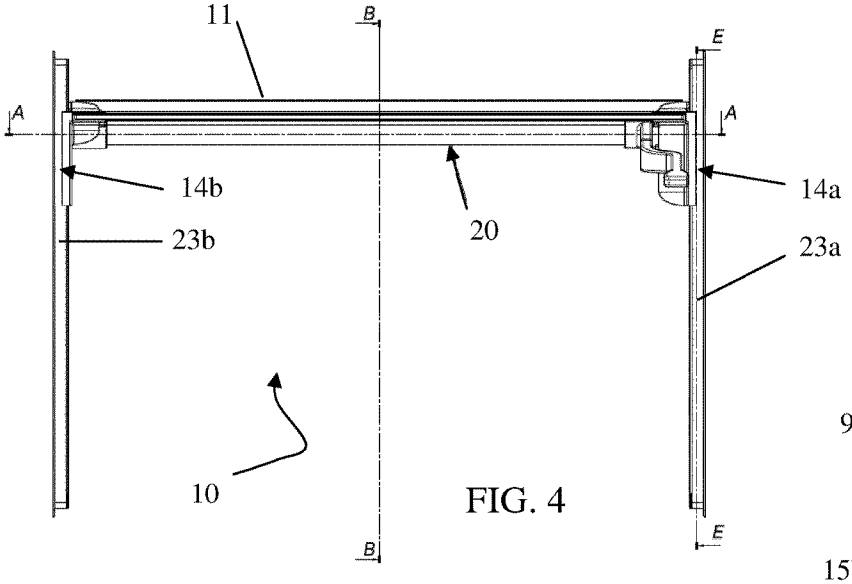
FIG. 4 is a front view of the cabinet support assembly of FIGS. 2 and 3.
Figure 3:
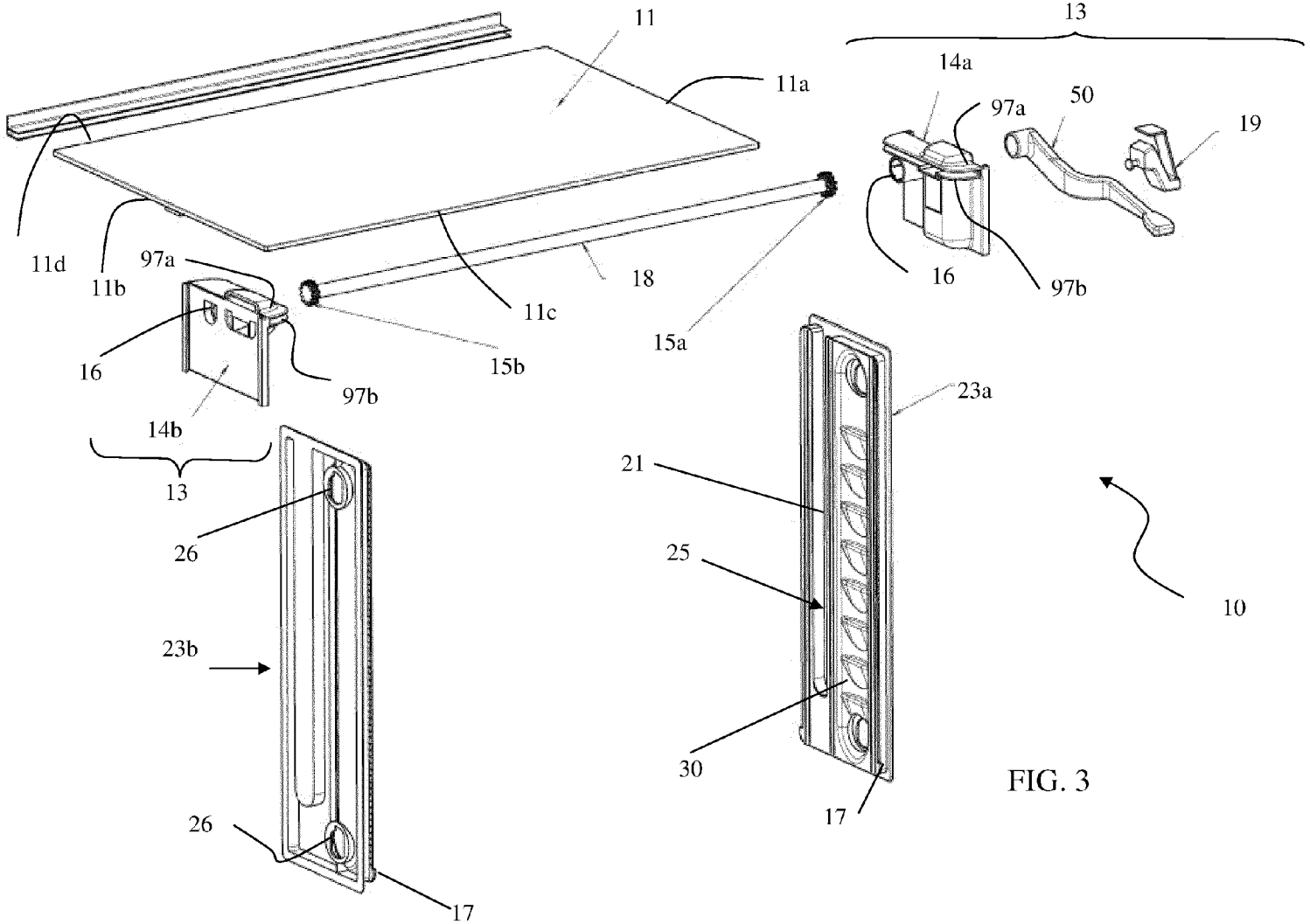
FIG. 3 is a perspective exploded view of the cabinet support assembly of FIG. 2.
Figure 18C:
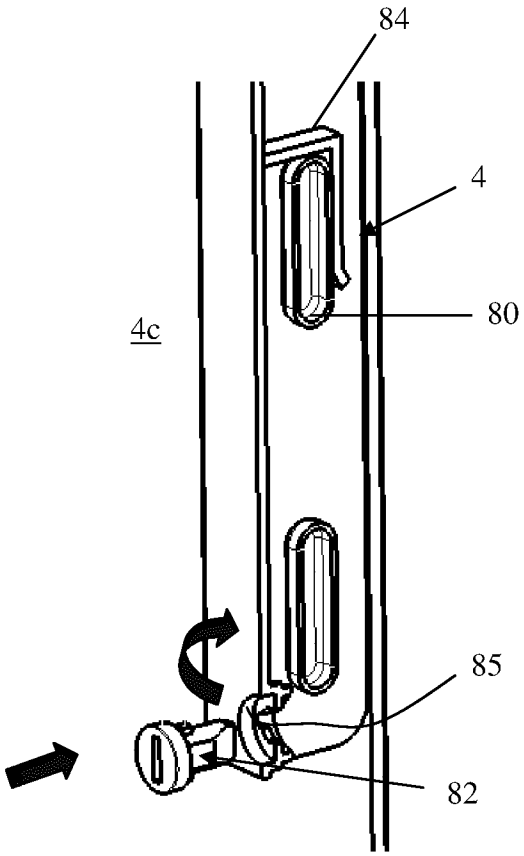
Figure 18B:
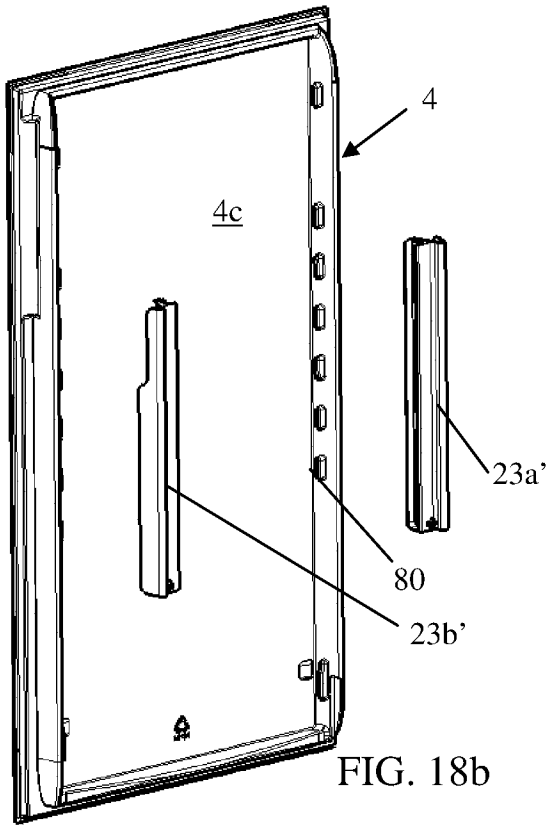
Figure 18A:
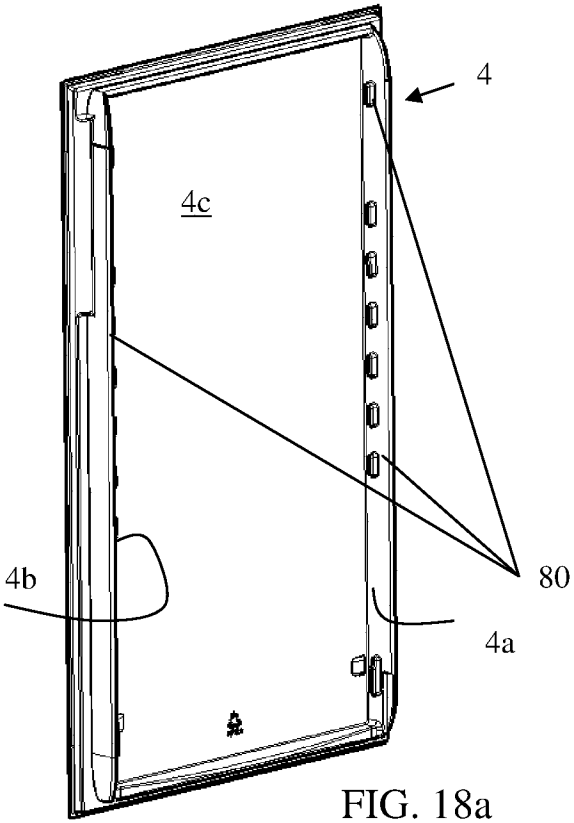
Figure 20:
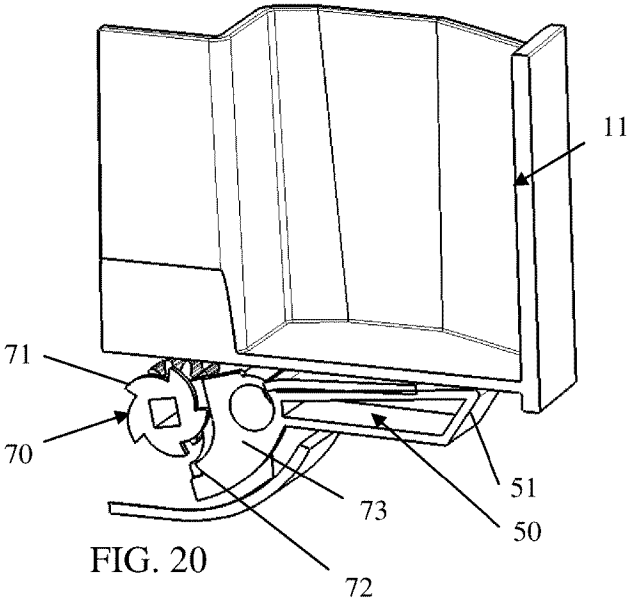
Figure 19:
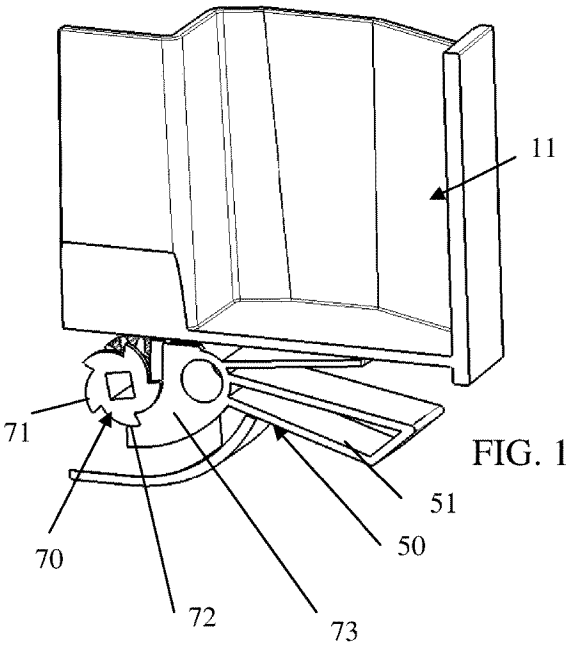
Figure 21:
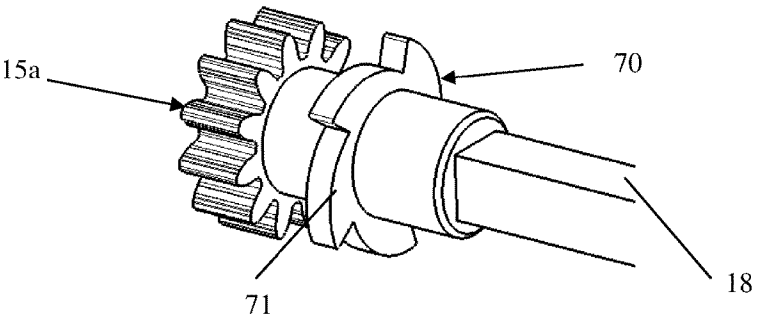
Figure 22B:
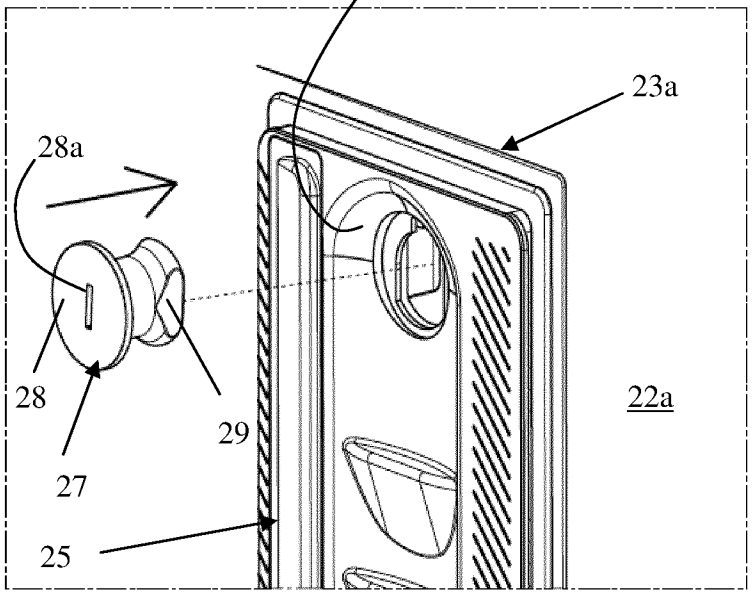
Figure 22A:
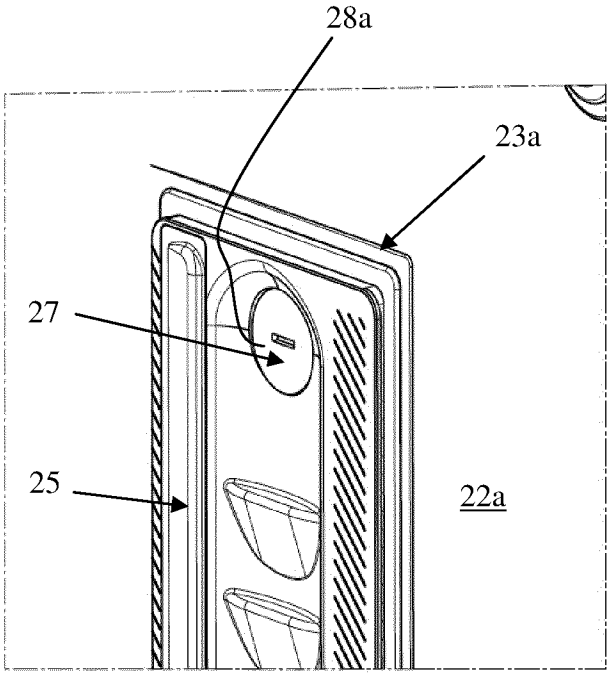
Figure 24A:
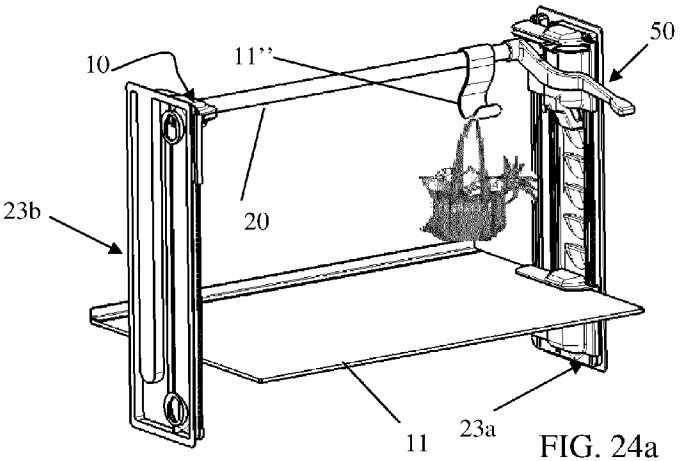
Figure 24B:
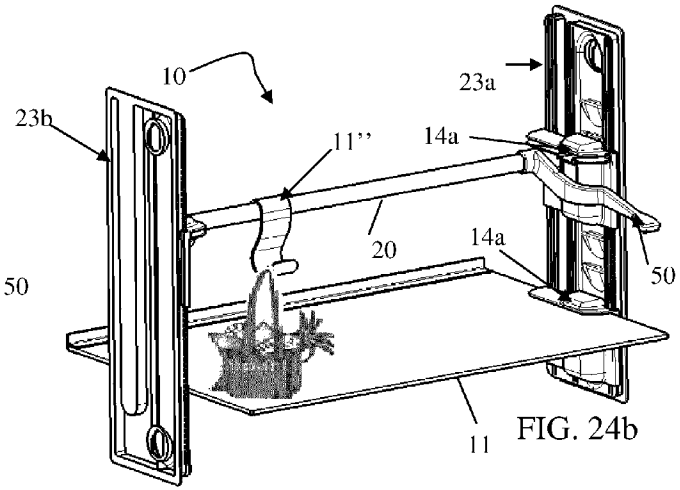
Figure 23A:
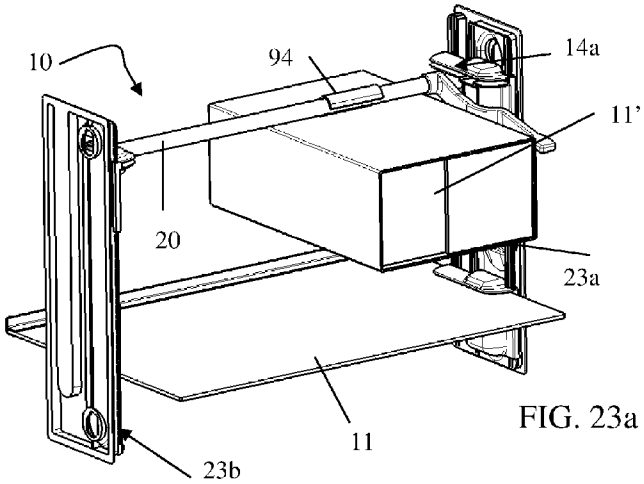
Figure 23B:
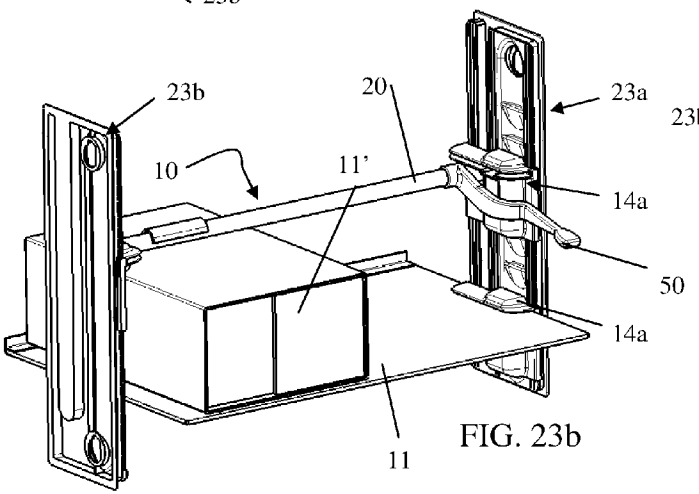

FIGS. 18*a*-18*c* are perspective view of various steps for the mounting of the door support assembly rails of FIGS. 15-17 on a door for refrigerating appliances;

FIG. 19 is a perspective view of a detail of the door support assembly of FIG. 17 in a first operative position (engaged);

FIG. 20 is a perspective view of the same detail of the door support assembly of FIG. 19 in a second operative position;

FIG. 21 is a perspective view in an enlarged scale of a further detail of the door support assembly of FIG. 17;

FIGS. 22*a* and 22*b* are two partial perspective views of a detail of a rail for the attachment of the cabinet support assembly of FIGS. 1-3 on the refrigerator cabinet in a first and a second operative position;

FIGS. 23*a* and 23*b* are two perspective view of an additional embodiment of a cabinet support assembly according to the invention;

FIGS. 24*a* and 24*b* are two perspective view of a further additional embodiment of a cabinet support assembly according to the invention.

In the figures, elements that are identical or that fulfill the same function bear the same reference numeral. In addition, the figures are in some cases oversimplified and elements are removed in order to enhance clarity of the same to better show and describe the present invention.

With initial reference to FIGS. 1 and 1*a*, a refrigerating appliance 1 includes a body 2, in which a refrigerating compartment 3 is defined, and a door 4 that can be opened or closed to access or close the refrigerating compartment 3 in a conventional manner. For example, the door 4 can be pivotally mounted to the refrigerator body 2 via hinges (not shown).

In addition, refrigerating appliance 1 includes at least a support assembly the position of which can be adjusted along the vertical axis. The support assembly can be either a cabinet support assembly, i.e. an assembly including a support member mounted within the refrigerator compartment 3, or a door support assembly, i.e. a support assembly including a support member fixed on the side of the door 4 facing the compartment 3. In the following, in order to distinguish the two different support assemblies which use the same teaching of the invention, the reference numeral 10 or 10' indicates a cabinet support assembly, while 100 a door support assembly.

Moreover, in the following, particular reference will be made to shelves as preferred example of support members, but other types of support members will also be depicted.

Refrigerating appliance 1 may include one or more of the cabinet/door support assembly according to the invention and one or more fixed shelves, i.e. shelves the height of which is not modifiable, and/or shelves the height of which can be modified according to the teaching of the prior art.

In all the figures, with the exception of the support assembly 10, 10', 100, further elements and/or details of the refrigerating appliance are not shown and are considered to be know in the art.

It addition, the refrigerating appliance 1 might include more than one refrigerating compartment 3 and thus more than one door 4 (for example two doors as in the embodiment of FIG. 1), the additional doors being similar or different to the one hereby described. Moreover, the meaning of "refrigerating appliance" includes refrigerators as well as freezers.

The refrigerating appliance 1 includes walls surrounding and defining the refrigerating compartment 3, in particular it includes two first and second opposite lateral walls 22*a*, 22*b*, floor and ceiling walls 22*c*,22*d* also opposite one to the other and a rear wall 22*e* substantially perpendicular to the lateral walls 22*a*,22*b*. The rear wall 22*e* is substantially facing door 4 when the latter is closed to seal the compartment 3, in a manner known in the art. As an example, the walls of the compartment may be integrally molded from a liner.

Within the compartment 3, at least a rail is mounted on a wall in a substantially vertically extending configuration. The rail might be mounted on one of the lateral walls 22*a*, 22*b* or on the rear wall. According to a preferred embodiment of the invention, the refrigerating appliance 1 comprises a first and a second rails 23*a*, 23*b*, facing one the other, the first (second) rail 23*a* (23*b*) being mounted on the first (second) lateral wall 22*a* (22*b*). It has to be understood that according to a different embodiment of the invention, not depicted in the drawings, the two rails can be both attached to the rear wall of the appliance 1 at a given distance one from the other.

Rails 23*a*,23*b* may support all the height-adjustable cabinet support assemblies 10,10' present in the refrigerating appliance 1, or the appliance 1 may comprise a plurality of rails' pairs and each height-adjustable support assembly present in the appliance 1 may be connected to a different pair of rails. All the intermediate possibilities are also included in the present invention, i.e. a pair of rails is used for some but not all of the height-adjustable cabinet support assemblies present in the refrigerating appliance 1. Therefore, the appliance 1 may include a single pair of rails vertically mounted in the compartment 3 extending substantially for the whole height of the same, or it may comprise a plurality of pairs of rails facing one the other and positioned one on top of the other along two parallel vertical lines thus forming two vertical columns.

Figure 6:
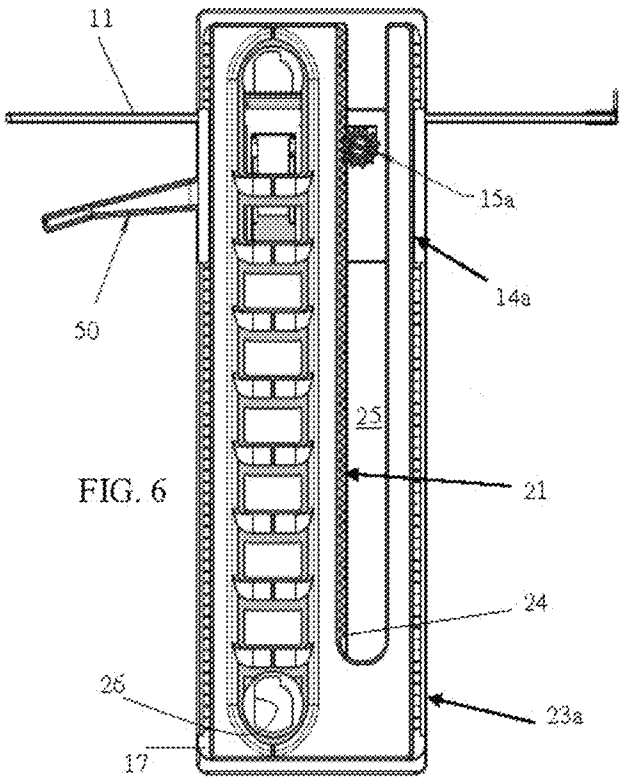
FIG. 6 is a cross-section along the line E-E of FIG. 4 of the cabinet support assembly.

As better seen in FIG. 6, each rail 23*a*,23*b* includes a guide member 25, delimited by vertical walls (not labeled) defining a seat, which extends substantially parallel to the vertical extension of the rail 23*a*,23*b*. The guide 25 comprises on one of its wall a rack portion 21 having a plurality of vertically spaced apart and laterally extending teeth 24. On each guide member 25, in particular within the seat defined by its walls, a gear mounted on the support assembly is inserted, as better detailed below. The teeth 24 are disposed substantially perpendicular to the wall 22*a*,22*b* to which the rail 23*a*,23*b* is fixed. However, the specific positioning and orientation of the rack portion 21 can be different from the one shown in the drawing, as long as it can be engaged with the mentioned gear present in the support assembly.

Rails 23*a*,23*b* preferably are integral pieces and are realized molding a thin sheet of plastic or metal. According to a preferred embodiment of the invention, rails are fixed to an inner liner of the refrigerating compartment 3 in the following manner. With reference to FIGS. 22*a* and 22*b*, a recess 26 having a non-circular opening is formed in proximity of both ends of the rail 23*a*,23*b* (only one end of the rail 23*a* is visible in the mentioned figures) and corresponding recesses (not visible in the drawings) are formed in the inner liner of the compartment 3, for example these recesses can be thermoformed in the liner. In order to fasten the rails 23*a*,23*b* to the liner, a screw 27 having a head 28 and a cam-like ending 29 is inserted in the recess 26 (see FIG. 22*b*) and in the superimposed recess formed in the liner: the cam-like ending 29 can enter the opening of the recess 26 only when it is aligned along a first orientation. When inserted, by a rotation of the head 28 with a suitable tool, such as a coin (for example by means of a slit 28*a* formed in the head 28), the cam-like ending 29 becomes aligned along a different orientation and thus interferes with the edges of the recess 26 opening and the screw 27 cannot exit the recess 26 (and the corresponding recess on the liner), fixing in this way the rail on the liner. This simple fastening allows an easy removal of the rail from the compartment 3 for cleaning purposes.

Other fastening means, as standard screws or rivets, can be used in different embodiment of the invention to fasten the rails to the liner.

According to an embodiment of the invention depicted in FIGS. 2-6, one of the rails 23*a*, 23*b* (rail 23*a* in the depicted example) comprises a plurality of protrusions 30 (see in particular FIG. 5). If only one rail is present, this rail can be provided with the protrusions 30.

The protrusions 30 are vertically spaced one from the other and substantially aligned one on top of the other substantially forming a "ladder", which is disposed parallel to the guide member 25. The rack portion 21 and the plurality of protrusions 30 extend substantially for the same portion of the rail 23*a*. Each protrusion 30 extends starting from the rail 23*a* towards the interior of the compartment 3. As clearly seen in the cross section of FIGS. 9*a*, 9*b* and 10, the protrusions 30 have substantially the shape of upside down half-pyramids, i.e. each protrusion comprises a flat plate 31 disposed perpendicular to the vertical extension of the rail 23*a* and substantially parallel to the ceiling/floor walls 22*c*,22*d*. Two consecutive plates 31 vertically spaced apart are connected by an inclined wall 32 connecting the innermost edge of the lower plate to the outermost edge of the upper plate. In this manner a recess 30*a* is defined between two adjacent protrusions 30 (see the enlarged views of FIGS. 9*a* and 9*b*). According to a different embodiment of a cabinet support assembly 10' of the invention, with now reference to FIGS. 11-14, the rails 23*a*,23*b* do not include the plurality of protrusions 30. The difference between the functioning of the two embodiments will be explained below.

Going back to the embodiment of FIGS. 2-10, the cabinet support assembly 10 includes a supporting member, in the depicted example a platform shelf 11, made by any suitable material such as plastic glass or wire, which may also include a frame (not shown) surrounding the shelf 11 completely or partially, i.e. only one or more of the sides of the shelf may be attached to the frame. Shelf 11 defines two opposite lateral sides 11*a* and 11*b*, as well as a front side 11*c* and a back side 11*d*. When in use, i.e. when attached within the compartment 3, the shelf 11 is positioned substantially parallel to the floor/ceiling walls 22*c*,22*d* and the lateral sides 11*a*,11*b* are connected to respective lateral walls 22*a*,22*b*.

It is to be understood that platform shelves are only one example of supporting member that can be used in the appliance of the invention, and different types of supporting members, such as a storage bin 11' as depicted in FIGS. 23*a* and 23*b*, a hook 11" for hanging various items as depicted in FIGS. 24*a* and 24*b*, a drawer (not shown) or other types of shelves can be used as well.

The cabinet support assembly 10 further includes mounting elements 13 comprising at least a runner and a gear for the connection of the shelf 11 to the refrigerating compartment 3. More preferably, the mounting elements 13 include two runners 14*a*,14*b* and two gears 15*a*,15*b* located substantially at the two opposite lateral sides 11*a*, 11*b* of the shelf 11. In the following, only the embodiment including two runners and two gears will be described, but a different embodiment including a single couple gear/runner or more than two gears/runners is possible as well.

In addition, in case one or more rails are fixed on the rear wall of the refrigerating appliance 1, the one or more runners (a runner for each rail) are fixed to the back side 11*d* of the shelf.

According to a different embodiment of the invention, shelf 11 and runners 14*a*,14*b* are an integral piece and they are for example molded in plastic.

Each runner 14*a*,14*b* is coupled to one of the lateral sides 11*a*,11*b* of the shelf 11, for example runner 14*a*,14*b* includes two opposite parallel pair of lips 97*a*,97*b* between which the shelf 11 is inserted and fixed. Additionally, the runner is vertically extending in a manner substantially perpendicular to the shelf 11 and substantially parallel to the vertical extension of the rails. The cross—section of each runner along a plane parallel to shelf 11 is U-shaped and has a dimension that interlocks with the one of the rail, so that each runner 14*a*,14*b* can be fit outside a corresponding rail 23*a*,23*b* in order to allow vertical sliding movement of the shelf 11 and at the same time limiting and preventing relative movements in the other directions. In other words each U-shaped runner embraces the outer edges of the corresponding rail so as to engage one with the other.

Preferably, a stop element, such as a protruding tooth 17, is positioned at the lower end of the rail 23*a*,23*b*, in order to block the sliding of the runner at the end of the rail and avoid the accidental removal of the runner from the rail. Each runner comprises also a through-aperture 16 (see FIG. 3 where only the aperture in runner 14*b* is shown), the two apertures—one per runner—being aligned so as to face one the other. Gears 15*a*,15*b* are connected by a shaft 18 so that rotation of any one of the two gears implies an analog rotation of the other of the two gears. Preferably, gears 15*a*,15*b* are mounted at the two opposite ends of shaft 18. Shaft 18 is coupled to shelf 11, in particular it is attached in a rotatably manner to the two runners 14*a*,14*b*, so that it follows the vertical movements of the shelf 11 and at the same time it is allowed to rotate along its axis. Preferably, a shaft cover 20 (see FIGS. 7 and 8) covers the shaft 18 during its rotations, so that objects and clothes are not snagged on it, or the users is not hurt. The length of the shaft 18 is substantially equal, or slightly longer, than the width of shelf 11, so that, when mounted substantially parallel to the shelf 11, it passes through the two runners 14*a*,14*b* via apertures 16. In this manner, gears 15*a*,15*b* can engage with the rack portions 21 of the rails. However, regardless of the details of the mounting of the shaft 18 with respect to the shelf 11, an important aspect is that the shaft 18 is supported by runners 14*a*,14*b* for relative rotation about an axis defined by the shaft itself and that the gears rotate in unison with shaft 18. This can be accomplished in many ways; in the present embodiment for example a journal (not shown) can be mounted in each of the apertures 16.

Indeed, in case the support assembly 10 is not a platform shelf as in this depicted embodiment, but for example a container bin, the shaft 18 can be much longer than the width of the bin.

Runners 14*a*, 14*b* and gears 15*a*,15*b* are substantially parallel one to the other. The relative lengths of shelf 11, runners 14*a*, 14*b* and shaft 18 are such that, when the two runners 14*a*, 14*b* are coupled to the rails 23*a*, 23*b*, each gear 15*a*, 15*b* is inserted in the corresponding guide portion 25 including the rack portion 21.

With this construction is should be apparent that vertical movements of the shelf 11 are caused by the rotation of the two gears 15*a*, 15*b* on the rack portions 21 located in the rails 23*a*, 23*b*. Tilting of the shelf is avoided by the unison movement of the two gears 15*a*, 15*b* which are connected by shaft 18, regardless of the point in which a force is applied to the shelf 11 to move the same.

It is apparent that there is a need also of a limiting element which controls the movement of the shaft 18 which, by gravity, is otherwise immediately confined to settle in the lowermost position allowed by the rails 23*a*, 23*b* to which is connected.

Support assembly 10 includes a unidirectional stopper unit that, when engaged, allows movement of the shelf only in one direction, i.e. it allows upwards movements of the shelf 11 but it blocks downwards movements of the same. In order to move the shelf 11 also downwardly, the unidirectional stopper unit has to be disengaged. The type of stopper unit is what differentiates embodiment 10 of FIGS. 2-10 and 23*a*-24*b*, from the embodiment depicted in FIGS. 11-14 and labeled with 10'. In the following, the embodiment 10 will be described first.

One of the runners 14*a*,14*b* (runner 14*a* in the depicted embodiment), or all of them, includes said unidirectional stopper unit, in particular it includes a resilient element, in the embodiment 10 a clip 19 made of elastic material, preferably plastic material.

Preferably, the clip 19 is located inside a seat 40 formed in the runner 14*a*, as shown in FIGS. 9*a*, 9*b*. The clip 19 has the functions of a snap-in element engaging between the recesses 30*a* formed between protrusions 30 so as to block the shifting of the shelf along the vertical axis. The clip 19 can thus be compressed and decompressed in order to be engaged/disengaged from the recess 30*a*. The clip 19 includes a substantially V-shaped element having a first and a second branch 19*a*, 19*b* which can be elastically compressed so as to reduce the spacing therebetween. The tip 19*c* of the V-shaped element has a wedge-like shape and protrudes from the surface of the runner facing the rail 14*a*. When the support assembly 10 is mounted on rails 14*a*,14*b*, the location of the clip 19 is such that tip 19*c* can be inserted between protrusions 30, i.e. clip 19 faces the protrusions ladder so that tip 19*c* can be housed in one of the recesses 30*a*.

More in detail, the support assembly 10 can be assembled in the compartment 3 by coupling the two runners 14*a*, 14*b* with the two rails 23*a*,23*b* and be vertically positioned by sliding the same. In order to lock the support assembly 10 in a given vertical position, i.e. to avoid that the shelf 11 moves downwards by gravity action, the tip 19*c* of the clip 19 is placed in the recess 30*a* formed between two adjacent protrusions 30 corresponding to the given position. Downwards movements of the shelf 11 are thus not allowed: sliding of the runner 14*a* on the rail 23*a* is not possible because the tip 19*c* abuts the plate 31 of protrusions 30. However, by application of a thrust on the support assembly 10, for example on shelf 11, i.e. applying a upwardly oriented force to shelf 11, the support assembly 10 can slide upwardly as detailed below.

The first and second branches 19*a*, 19*b*, which with one end converge to the tip 19*c*, on their opposite end are respectively protruding from a surface of the runner 14*a* opposite to the surface from which tip 19*c* emerges (first branch 19*a*) and fixed to the runner 14*a* in a point inside the seat 40 (second branch 19*b*). The second branch 19*b*, which is fixed to the runner 14*a* for a given portion of its extension, in one operative condition (see FIG. 9*a*) substantially runs along the inclined wall 32 present between two adjacent protrusions 30. As mentioned, the clip 19 is elastic and it can be compressed: by applying an upward thrust to the shelf 11, due to the fact that between two adjacent plates 31 the inclined wall 32 is present, the latter slowly compresses the second branch 19*b* of the clip 19, which is thus forced to bend, to retract into seat 40 and to slide over the next protrusion 30.

This configuration, i.e. the configuration in which the tip 19*c* is inserted in the recess 30*a* between two protrusions 30, is the so-called "engaged configuration" of the unidirectional stopper unit and it is depicted in FIG. 9*a*.

Figure 7:
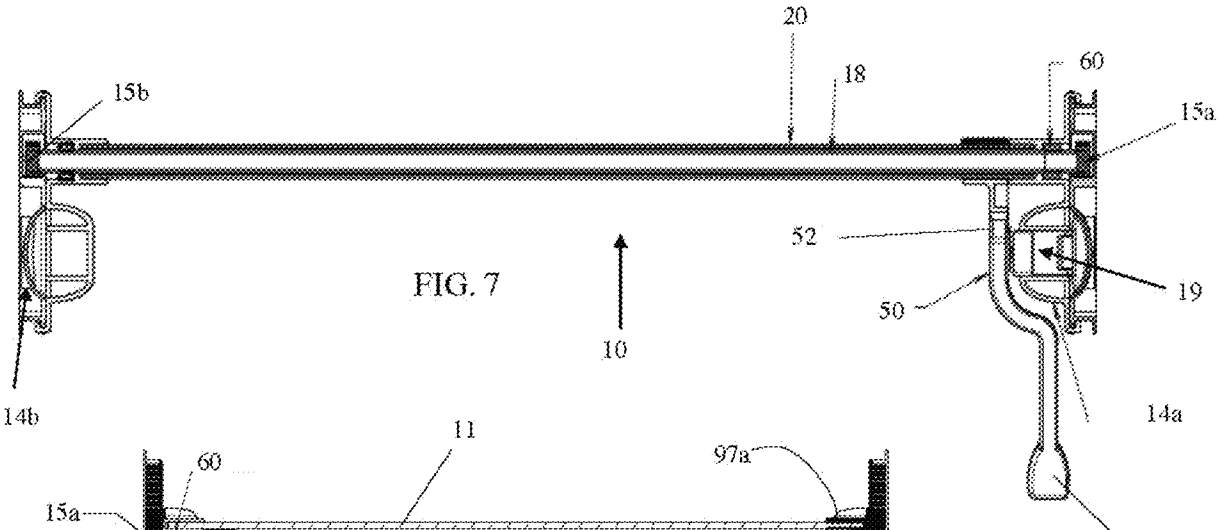
FIG. 7 is a cross-section along the line A-A of FIG. 4 of the cabinet support assembly.
Figure 8:
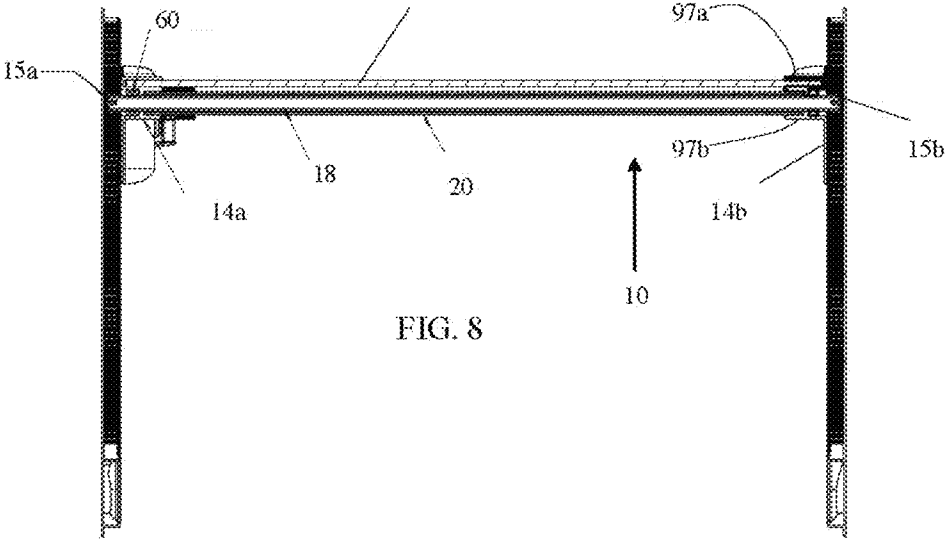
FIG. 8 is a cross section along the line C-C of FIG. 5 of the cabinet support assembly.

It is also desired to obtain vertical movements of the shelf 11 in the downwards direction, not only in the upwards direction as above described. In this respect, the unidirectional stopper unit includes also a lever 50 fixed to at least one of the two runners 14*a*, 14*b*, and in particular to the runner on which the clip 19 is mounted. The fulcrum of lever 50 is hinged on the surface of the runner 14*a* from which branch 19*a* emerges. As shown in FIGS. 7, 9*a* and 9*b*, lever 50 includes an operating handle 51 and an abutment portion 52, which cooperates with branch 19*a* of the clip 19 in order to disengage the unidirectional stopper unit and allow downwards movement of the shelf 11. As mentioned, the first branch 19*a*, with its free end, protrudes from the surface of the runner 14*a* below the shelf 11 (even though the specific positioning of the clip 19, i.e. whether it is located above or below the shelf, is of no relevance to the invention) and abuts on top of the abutment portion 52 of the lever 50. Therefore, by operating lever 50, e.g. by moving upwards the lever 50 using the handle 51, it is possible to move the first branch 19*a* upwards and consequently to compress the two branches 19*a*,19*b* of the V-shaped element. Due to the upward movement of the branch 19*a* , the tip 19*c* retracts inside the seat 40 and it is not engaged any more in the recess 30*a* formed between the two protrusions 30 (see the configuration in FIG. 9*b* with the tip 19*c* substantially completely retracted inside seat 40). The stopper unit is thus moved from the engaged to a disengaged position, as shown in FIGS. 9*a* (engaged) and 9*b* (disengaged) by the action on lever 50. In the disengaged position, the absence of a stop allows free vertical movements of the shelf 11, obviously both upwards and downwards, due to the sliding of the runners 14*a*,14*b* on rails 23*a*,23*b*.

The disengagement of the clip 19 from the protrusions 30 may cause a sudden vertical fall of the shelf 11, in particular when it is loaded with items. In order to avoid such hazardous quick descent, a brake device 60 (see FIGS. 7 and 8 or in the second embodiment of FIG. 12) is included in the support assembly 10. The brake device can be any shift limiting element, for example an element using friction forces, which slows down the downwards movement of the shelf 11. As an example, the brake device 60 can be a grommet (see FIG. 12) which is fixed to one of the runners 14*a*,14*b* (or more than a grommet may be used) which work coaxially with shaft 18. The size of the grommet is calibrated in order to obtain a friction force opposite to the rotation of the shaft 18: the friction force therefore creates a counterforce slowing down the downwards movement which is obtained when the lever 50 is operated.

With now reference to the support assembly 10' of FIGS. 11-14, the main differences between the two embodiments 10, 10' lies in the construction of the unidirectional stopper unit. In the support assembly 10', no protrusions 30 and no clip 19 are present, stopper unit includes a unidirectional gear wheel 70 whose teeth are meshing with another toothed part present in lever 50 and which will be better described below. Gear wheel 70 is mounted coaxial to gears 15*a*, 15*b* on shaft 18 and rotates with the same. Preferably gear wheel 70 is mounted in proximity to the gear 15*a*. Gear wheel 70 includes a plurality of asymmetric teeth 71 (see FIGS. 13 and 21) exerting an asymmetric torque: the teeth in cross section are substantially hook-shaped and the lever 50 includes at least an indent 72 the shape of which substantially mates the shape of the teeth 71.

As in the embodiment of support assembly 10, the fulcrum of lever 50 is hinged on the surface of the runner 14*a* opposite to rail 23*a*. Lever 50 includes a head 73 comprising indent 72 (see FIG. 12 and—in particular—the enlarged detail of FIG. 13), which cooperates with gear wheel 70, in particular gear wheel 70 and head 73 are mutually engaging. Therefore, in case of rotation in one direction—which is chosen by the mounting of the unidirectional gear wheel 70 on the shaft 18 to be the rotation corresponding to upwards movement of shelf 11—the head 73 of the lever slides on the wheel 70, while in case of rotation in the opposite direction, the shape-fitting of one of the tooth 71 with the indent 72 blocks any further movement downwards of the shelf 11. Therefore, as in the above described embodiment 10, applying a thrust on the shelf causes rotation of the gears 15*a*,15*b* on rack portions 21 and thus rotations of the gear wheel 70 which slides on the head 73 which in turn implies an upwards movement of shelf 11. The condition in which gear wheel 70 is engaged with lever head 73 is the engaged condition of the unidirectional stopper unit and it is depicted for example in FIG. 13.

As in the embodiment 10, it is possible to operate lever 50, for example by pulling upwards the handle 51, so that the unidirectional wheel 70 is disengaged from the indent 72 on the head 73. When the engagement is removed, there is no obstacle in a free sliding of runners 14*a*,14*b* on rails 23*a*,23*b* and thus of vertical movements of the shelf 11. Furthermore, also in this embodiment, a brake device 60 (see FIG. 12) is provided to slow down the downwards movements.

Therefore, according to the invention, with a simple thrust on the shelf 11 of the support assembly 10 or 10', regardless of the position where said thrust is applied on, the shelf 11 can be moved upwards in an easy manner using a single hand and without the need to operate any device. In case of support assembly 10, the thrust forces the clip 19 to compress disengaging tip 19*c* from recess 30*a* and the shelf 11 moves from one protrusion 30 to the following protrusion. The minimum distance between two different vertical positions of shelf 11 is thus the vertical distance between two different protrusions 30, in particular the distance between plates 31. In case of embodiment 10', the thrust forces the unidirectional wheel 70 to slide on the head 73 of lever 50 thus allowing the upper movement. The minimum distance between two different vertical positions of shelf 11 is thus determined by the pitch of the gear wheel teeth 71.

The disengagement of the stopper unit allows downwards movements of the shelf 11: in both cases the disengagement is obtained by operating lever 50 which either forces the tip 19*c* to disengage from the recess 30*a* between protrusions 30 (embodiment 10) or disengages the head 73 from the unidirectional gear 70 (embodiment 10').

In the above, two different embodiments of cabinet support assemblies 10,10' have been described, however the teaching of the present invention can be applied as well to door support assemblies 100, i.e. support assemblies which are connected to the door of the refrigerating appliance 1.

As depicted in figs. from 15 to 21, and with initial reference to FIGS. 15 and 16, support assembly 100 is apt to be fixed to a standard door 4 of the refrigerating appliance 1: the door 4 can be open or closed to access or close the refrigerating compartment 3 in a conventional manner, for example it can be pivotally mounted to the body 2 of the refrigerator 1 via hinges (not shown). According to a preferred embodiment, the door 4 includes an inner surface which is facing the refrigerating compartment 3 when the door 4 is closed and which defines two substantially parallel first and second side walls 4*a*,4*b* which are inwardly projecting with respect to the refrigerating compartment 3 from a substantially flat rear wall 4*c*, to define a cavity in the door 4. On said lateral walls 4*a*,4*b*, the door 4 includes a plurality of spacers 80 for the attachment of shelves according to the prior art. Spacers 80 are known in the field and not further described in the following.

The support assembly 100 can be mounted—among others—on refrigerating appliance 1 realized according to the prior art, i.e. refrigerating appliances comprising said spacers 80 for the regulations of shelves. The support assembly 100 comprises at least one rail, more preferably two rails 23*a*', 23*b*' to be vertically mounted one facing the other on the two opposite lateral walls 4*a*,4*b* and to be fastened on the spacers 80. The rails 23*a*',23*b*' are substantially analogous to rails 23*a*,23*b* described with reference to the cabinet support assemblies 10, 10', and in addition, as shown in FIGS. 18*a*-18*c*, they preferably include attaching means in order to be firmly fixed to the spacers 80, for example a hook element 84. In the mentioned figures, the mounting of rails 23*a*',23*b*' on door 4 is depicted: each rail 23*a*', 23*b*' includes the hook element 84 and each rail 23*a*',23*b*' is inserted on a respective column of spacers 80 of door 4 and pressed downwardly so that the hook element 84 of each rail hooks on one spacer 80 to hold the rail 23*a*', 23*b*' on the respective lateral walls 4*a*,4*b*. A blocking key 82 is then inserted in a suitable opening 85 at the lower end of each rail 23*a*',23*b*' and rotated by 90° in order to fix the rail. This system allows the user to eventually unfasten the rails from the door in an easy manner for example for cleaning purposes. It is to be understood that rails 23*a*', 23*b*' can be directly molded on the lateral sides of door 4 or attached to said lateral walls as described with reference to FIGS. 22*a*, 22*b* or in any other way known to the man skilled in the art.

In the depicted embodiment, the door support assembly 100 includes a shelf 11 having a bin shape. Runners 14*a*,14*b* and shelf 11 are integral in a single piece: the two runners are the side walls of the bin having a L shaped cross-section so as to be inserted in rails 23*a*',23*b*' fixed on the lateral walls of the door 4. However, an additional possible embodiment of the door support assembly (not shown) comprises separated runners 14*a*,14*b* which are then attached to the shelf 11, in a configuration as described with reference to embodiments 10 and 10'.

As shown in the partial cross-section of FIG. 16*a*, each runner 14*a*,14*b* includes a plurality of projections 93 (two in the depicted embodiment, which are substantially cylindrical) which are inserted in the respective guide 25 and help to maintain the bin 11 in the correct vertical orientation without tilting of the same. The functioning is similar to the embodiment 10' above described: the two runners are coupled with the two rails 23*a*',23*b*' so as to have a sliding movement of the door support assembly 100 on the rails, but in this embodiment there is also the insertion of the projections 93 into the guide 25. As previously, two gears 15*a*,15*b* connected by shaft 18 are responsible for the vertical movement of the bin 11 due to the meshing of the gears with rack portions 21 (see FIG. 16*a*) present in rails 23*a*',23*b*'. Shaft 18 is preferably located below the bin 11 and both gears 15*a*,15*b* are inserted in the respective guide portions 25 realized in the rails 23*a*',23*b*' as described with reference to embodiment of cabinet support assembly 10 and 10'.

The unidirectional stopper unit includes the gear wheel 70 which is fixed on shaft 18 close to gear 15*a*, and the lever 50 for the disengagement of the stopper unit. The functioning of the unit is analog to the functioning of the unit described with reference to cabinet support assembly 10'. However it is to be understood that a stopper unit analog to that described with reference to the cabinet support assembly 10 can be employed as well. To move up the door support assembly 100, a thrust given for example by a hand under the bin 11 makes the lever 50 slide on the gear 70 so that the upwards movement is allowed. As soon as the force is interrupted and the gear 70 starts to rotate on the opposite direction due to gravity, the engagement of the gear teeth 71 with the indent 72 in the lever head 73 blocks the bin 11 in the desired position. This "engaged" configuration is shown in FIG. 19; see also FIG. 21 in which an enlarged view of wheel 70 is presented.

To move the bin 11 down, it is required to push the lever 50, e.g. using handle 51, so that the gear wheel 70 is free to rotate and the bin 11 is forced by its own weight and by the weight of the items supported by it to move downwardly. To prevent an immediate falling, a brake device, such as a grummet 60, is placed inside a runner and works coaxially with the shaft 18. The friction force opposite to the falling force creates a slow movement down. This "disengaged" configuration is shown in FIG. 20. As the lever 50 is released, i.e. the handle 51 is left by the user, the head 73 of the lever 50 engages again with the unidirectional gear wheel 70 and the bin 11 is blocked in the new desired position.

In a further embodiment not shown in the appended drawings, in addition to the vertical regulation above described via rails 23*a*,23*b* or 23*a*',23*b*', the support assembly 10,10',100 can be also regulated horizontally, i.e. the shelf 11 can be regulated along a plane parallel to the wall/ceiling wall of the compartment 3. In this further embodiment, runners 14*a*,14*b* can comprise an additional guiding element between lips 97*a*, 97*b* to allow back and forth movements of the shelf 11 towards and away the door 4. With now reference to the FIGS. 23*a*, 23*b* and 24*a*, 24*b*, support assemblies 10 with different types of support members are depicted, in particular with both a platform shelf 11 and a bin 11' or a hook 11", to show the versatility of the present invention. Indeed, the vertical regulation above described can be applied not only in connection to standard shelves 11, but also in relation for example of bins 11': the runners 14*a*,14*b* and the shaft 18 connecting the gears 15*a*,15*b* are mounted on the rails 23*a*,23*b* as described, and the bin is connected for example to the shaft cover 20 (which does not rotate but simply vertical shifts together with the runners 14*a*, 14*b*) by attaching means 94. The bins 11' therefore can both move vertically as described and also slide along the shaft 18 (see the different positioning of the bin 11' in FIGS. 23*a* and 23*b*) so as to be positioned depending on the items' distribution in the refrigerating compartment 3.

In the example depicted, the same rails 23*a*,23*b* are used to support two different support assemblies 10.

Moreover, as shown in FIGS. 24*a*,24*b*, the support assembly 10 can include a hook 11" instead of a platform shelf 11.

The same can be applied to the cabinet support assembly 10' as well as to the door support assembly 100 to be fixed on the door 4 of the refrigerating appliance 1. In this latter case, the runners 14*a*,14*b* are not any more integrated in the bin 11 as depicted in the embodiment of FIGS. 15-20, but are separated from the same as in the cabinet support assembly 10,10'.

In this case, the thrust to move the shelf can be applied for example on the shaft cover.

According to the invention therefore, both cabinet and door support members can be easily regulated along the vertical direction. The support members can be moved upwardly or downwardly using a single hand without tilting problems. In addition, the support member position even downwardly can be easily adjusted without activating complex mechanisms. Moreover, multiple support members can be inserted in the same rails. The assembly is easy to remove and it can be completely disassembled by the user in an easy manner for cleaning.

The invention claimed is:

1. A refrigerating appliance including a body in which a refrigerating compartment is defined and a door connected to said body to open and close said refrigerating compartment, and a height adjustable support assembly connected to said body or said door, said refrigerating appliance further comprising:

a first and a second rail each including a rack portion attached to said body within said compartment or to said door, wherein said rail extends substantially along a vertical axis;

wherein said height adjustable support assembly comprises:

a support member to support items to be refrigerated or to be frozen, a first and a second gear rotatably connected to said support member and connected with each other by a shaft so that rotation of any one of the first and second gears implies a rotation also of the other one of the first and second gears, wherein said first and second gears each meshes with a corresponding rack portion on said first and second rails so that said support member can be vertically moved along said rail, a single unidirectional stopper unit regulating rotation of said first and second gears meshed with said rack portions, allowing an upward movement of said support member along said vertical axis and blocking downward movements along said vertical axis, and a single lever coupled to said unidirectional stopper unit, said lever being apt to disengage said unidirectional stopper unit so as to allow a downward movement of said support member along said vertical axis when operated, wherein said support assembly includes a brake element to slow down the downward sliding along said vertical axis when said unidirectional stopper unit is disengaged, wherein said lever and said unidirectional stopper unit are two separate pieces, and wherein said lever further comprises a handle that extends forwardly past said unidirectional stopper unit.

2. The refrigerating appliance according to claim 1, wherein said rail includes a plurality of protrusions defining recesses therebetween, said unidirectional stopper unit comprising a resilient element which engages one of said recesses to block said support assembly in a given vertical position.

3. The refrigerating appliance according to claim 2, wherein said resilient element is suitable to slides from one of said recesses to an adjacent one of said recesses along said vertical axis when an upward thrust is applied to said support assembly.

4. The refrigerating appliance according to claim 2, wherein said resilient element is coupled to said lever, so that said resilient element is removed from said recess when said lever is operated, so as to disengage said unidirectional stopper unit and allow free vertical movements along said vertical axis of said support assembly.

5. The refrigerating appliance according to claim 2, wherein said resilient element is a clip comprising a V-shaped element having a tip that is designed to engage into one of said recesses, and wherein said V-shaped element comprises a branch that is designed to be in abutment with said lever, so that when said lever is operated, said branch is moved and said tip is removed from said recess.

6. The refrigerating appliance according to claim 2, wherein said protrusions are vertically stacked and parallel to said rack portion, each protrusion comprising an inclined wall on which said tip can slide when said upward thrust is applied on said support assembly.

7. The refrigerating appliance of claim 2, wherein the protrusions are separate from the rack portions.

8. The refrigerating appliance of claim 7, wherein the protrusions are next to one of the rack portions and face toward another of the rack portions.

9. The refrigerating appliance according to claim 2, wherein when said lever disengages said unidirectional stopper unit from the rail, said lever moves in a direction different from a direction said unidirectional stopper unit moves.

10. The refrigerating appliance according to claim 1, wherein said unidirectional stopper unit comprises a unidirectional gear wheel rotating in unison with said first and said second gear, said unidirectional gear wheel being engaged with an indent on said lever.

11. The refrigerating appliance according to claim 10, wherein said unidirectional gear wheel includes asymmetric teeth configured so that when said unidirectional gear wheel rotates in one direction said unidirectional gear wheel slides on said lever, while when said unidirectional gear wheel rotates in the opposite direction, said unidirectional gear wheel is blocked in said indent.

12. The refrigerating appliance according to claims 10, wherein said unidirectional gear wheel is configured to disengage from said lever when said lever is operated, so as to disengage said unidirectional stopper unit and allow free vertical movements of said support assembly.

13. The refrigerating appliance according to claim 1, wherein said support assembly is a cabinet support assembly.

14. The refrigerating appliance according to claim 1, wherein said support assembly is a door support assembly.

15. The refrigerating appliance according to claim 1, wherein said support member is a platform shelf sitting on the shaft, or a bin or a hook hanging down from the shaft.

16. The refrigerating appliance according to claim 1, wherein said lever pulls said unidirectional stopper unit on a side of said unidirectional stopper unit opposite the rail.

17. The refrigerating appliance according to claim 1, wherein the shaft is weight bearing and bears weight of said support member.

18. A refrigerating appliance including a body in which a refrigerating compartment is defined and a door connected to said body to open and close said refrigerating compartment, and a height adjustable support assembly connected to said body or said door, said refrigerating appliance further comprising:

a first and a second rail each including a rack portion attached to said body within said compartment or to said door, wherein said rail extends substantially along a vertical axis;

wherein said height adjustable support assembly comprises:

a support member to support items to be refrigerated or to be frozen, a first and a second gear rotatably connected to said support member and connected with each other by a shaft so that rotation of any one of the first and second gears implies a rotation also of the other one of the first and second gears, wherein said first and second gears each meshes with a corresponding rack portion on said first and second rails so that said support member can be vertically moved along said rail, a single unidirectional stopper unit regulating rotation of said first and second gears meshed with said rack portions, allowing an upward movement of said support member along said vertical axis and blocking downward movements along said vertical axis, and a single lever coupled to said unidirectional stopper unit, said lever being apt to disengage said unidirectional stopper unit so as to allow a downward movement of said support member along said vertical axis when operated, wherein said lever and said unidirectional stopper unit are two separate pieces, and wherein said lever is a class 2 lever.

19. A refrigerating appliance including a body in which a refrigerating compartment is defined and a door connected to said body to open and close said refrigerating compartment, and a height adjustable support assembly connected to said body or said door, said refrigerating appliance further comprising:

a first and a second rail each including a rack portion attached to said body within said compartment or to said door, wherein said rail extends substantially along a vertical axis;

wherein said height adjustable support assembly comprises:

a support member to support items to be refrigerated or to be frozen, a first and a second gear rotatably connected to said support member and connected with each other by a shaft so that rotation of any one of the first and second gears implies a rotation also of the other one of the first and second gears, wherein said first and second gears each meshes with a corresponding rack portion on said first and second rails so that said support member can be vertically moved along said rail, a single unidirectional stopper unit regulating rotation of said first and second gears meshed with said rack portions, allowing an upward movement of said support member along said vertical axis and blocking downward movements along said vertical axis, and a single lever coupled to said unidirectional stopper unit, said lever being apt to disengage said unidirectional stopper unit so as to allow a downward movement of said support member along said vertical axis when operated, wherein said lever and said unidirectional stopper unit are two separate pieces, and wherein said unidirectional stopper unit and said lever are separate from said support member, and wherein said unidirectional stopper unit and said lever directly support the shaft.

* * * * *